United States Patent [19]

Maruhashi et al.

[11] 4,160,664

[45] Jul. 10, 1979

[54] PROCESS FOR PRODUCING ULTRA-LOW CARBON STAINLESS STEEL

[75] Inventors: Shigeaki Maruhashi; Yoshio Kobayashi, both of Tokuyama, Japan

[73] Assignee: Nisshin Steel Co. Ltd., Tokyo, Japan

[21] Appl. No.: 869,124

[22] Filed: Jan. 13, 1978

[30] Foreign Application Priority Data

Jan. 25, 1977 [JP] Japan ..... 52-6405

[51] Int. Cl.[2] ..... C21C 7/10

[52] U.S. Cl. ..... 75/49; 75/59; 75/60

[58] Field of Search ..... 75/49, 60, 59

[56] References Cited

U.S. PATENT DOCUMENTS

| | | | |
|---|---|---|---|
| 3,854,932 | 12/1974 | Bishop | 75/60 |
| 3,953,199 | 4/1976 | Michaelis | 75/60 |

*Primary Examiner*—P. D. Rosenberg

*Attorney, Agent, or Firm*—Stevens, Davis, Miller & Mosher

[57] ABSTRACT

A process for producing an ultra-low carbon stainless steel, which comprises preparing a molten metal of low carbon stainless steel by means of top-blowing of oxygen onto the surface of said molten metal contained in a vessel under reduced pressure, and while maintaining said molten metal under reduced pressure, blowing a mixed gas of an oxidizing gas and an inert gas into the low carbon stainless steel molten metal through a lance immersed in the melt.

10 Claims, 8 Drawing Figures

Figures 1A, 1B, 1C, 1D, 2A, 2B, 2C, 2D:
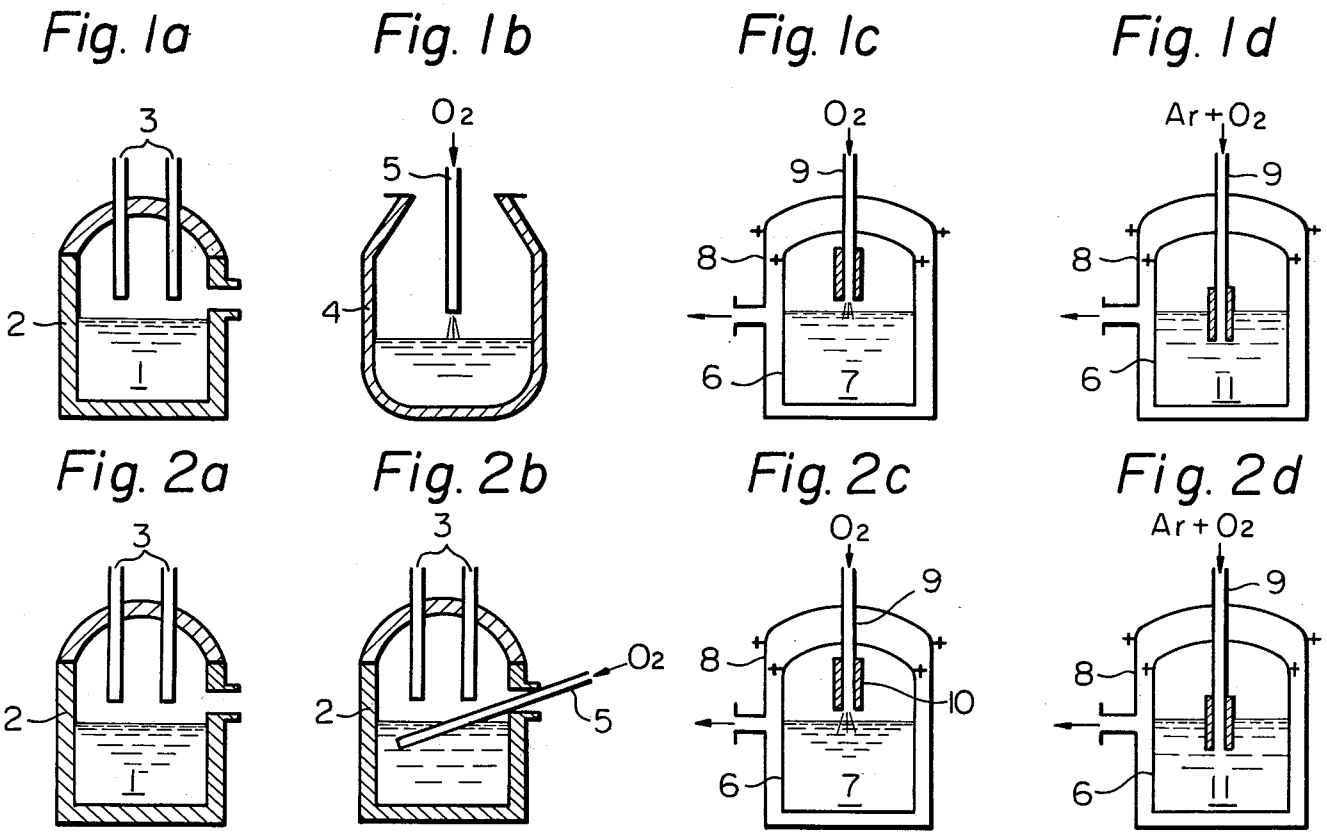

O2
Ar+O2
1
2
3
4
5
6
7
8
9
10
11

PROCESS FOR PRODUCING ULTRA-LOW CARBON STAINLESS STEEL

The present invention relates to a process for producing an ultra-low carbon stainless steel.

The extensively practiced processes for producing stainless steel at present are classified into two main processes; one is a vacuum refining process in which the finishing decarburization is carried out under reduced pressure, and the other is an inert gas dilution process, in which the finishing decarburization is carried out by means of an oxidizing gas diluted with an inert gas. In the former process, typically referred to as the VOD process, a chromium-containing molten metal (e.g., C: 2%, Ni: 8%, Cr: 20%) is, at the first stage, subjected to decarburization, usually with an oxygen top-blowing converter, to reduce the carbon content to about 0.2–0.3%. The molten metal then is subjected to a finishing decarburization in a vacuum refining furnace. In the latter process, referred to as the AOD process, a molten metal having a relatively high carbon content (e.g. C: 2%) is subjected to the decarburization to be carried out by using an oxygen gas diluted with an inert gas to reduce its carbon content directly to the target value without using additional treatment. Both of the two processes are designed to effectively proceed with decarburization in the finishing step (carbon reduction usually from about 0.3% or below) while suppressing oxidation loss of chromium. The principle mechanism of decarburization is the same for the two processes, and is the lowering of the partial pressure of carbon monoxide (hereinafter indicated as $P_{co}$). Thus, in the former case, the partial pressure of carbon monoxide is reduced by using vacuum atmosphere and in the latter case it is reduced by using an oxidizing gas diluted with an inert gas, so that effective decarburization is realized in both of the two processes while suppressing the oxidation loss of chromium.

However, the vacuum refining process and the inert gas dilution process, which are both based on the same mechanism, are limited with respect to their ability of lowering the $P_{co}$. So far as these processes are employed, it is difficult from a viewpoint of industrial practice to lower the carbon content of stainless steel, without loss of oxidized chromium, to an ultra-low carbon content (e.g. less than 0.01% C, particularly less than 0.005% C), which is required for a high quality stainless steel.

Since stainless steel has been widely used recently, a wide variety of properties are required for stainless steels. Particularly, for stainless steels which require high corrosion resistance and toughness, it is necessary to reduce the carbon content in the final stainless steel to less than 0.015% of carbon plus nitrogen, or less than 0.010% of carbon.

However, as mentioned hereinbefore, it is difficult to satisfy such requirements by the conventional processes. The limits of the conventional methods are due to the following reasons.

As mentioned hereinbefore, it is necessary to make the partial pressure of carbon monoxide ($P_{co}$) as small as possible, if it is desired to effect decarburization with a minimal oxidation loss of chromium. The partial pressure of carbon monoxide is defined by the following equation:

$$P_{co}=P_o=V_{co}/(V_{co}=V) \quad (1)$$

wherein, $P_{co}$=partial pressure of carbon monoxide (atm.)

$P_o$=pressure of atmosphere (atm.)

$V_{co}$=production of carbon monoxide ($m^3$/Hr)

V=supply of a diluent gas ($m^3$/Hr)

As noted from the equation above, it is necessary to make the ratio of $V_{co}/(V_{co}=V)$ as small as possible in order to reduce the $P_{co}$. However, according to the VOD process, it is practically impossible to reduce the $P_{co}$ to an extent sufficient enough to produce an ultra-low carbon stainless steel, since the supply of the diluent gas (V) is zero and the ratio of $V_{co}/(V_{co}=V)$ is equal to 1, although the pressure of atmosphere ($P_o$) is very small.

On the other hand, in case of the inert gas dilution process, it is also impractical to reduce the $P_{co}$ to a degree enough to produce an ultra-low carbon stainless steel, even by increasing the supply of a diluent gas to make the ratio $V_{co}/(V_{co}=V)$ smaller, because the pressure of the atmosphere ($P_o$) is 1, and too much of an increase in the diluent gas supply is not practicable, although the $P_{co}$ is reduced upon increase in the inert gas supply.

Further, decarburization to produce an ultra-low carbon steel (less than 0.01% C) is achieved by the deoxidation of $Cr_2O_3$ with carbon. This deoxidation reaction is a socalled metal-slug reaction. It is necessary in this reaction to make the molten metal bubble, particularly, in the region near the surface thereof.

From this viewpoint, it has been proposed to blow oxygen gas onto the molten metal surface maintained under reduced pressure while bubbling the melt with an argon gas introduced to the melt through a porous plug provided in the bottom of a vacuum refining furnace. However, it requires extended operation to finish the decarburization to a carbon content of about 0.005% or below, because of limited oxygen supply. The oxygen blowing in this case is called "soft blowing". In order to accelerate the decarburization reaction rate, therefore, the bubbling with the argon gas should be continued vigorously. However, such extensive bubbling results in much splashing of molten metal on the furnace wall at a reduced pressure, and too much of an increase in the argon gas supply is not practicable from an industrial viewpoint.

According to another proposed process, oxygen plus argon gas is blown into the molten metal through a nozzle or porous plug provided in a vacuum refining furnace. Reduction in the $P_{co}$ may be expected to some extent with this new process.

However, it is impractical to introduce the oxygen plus argon gas into the melt through a porous plug in an amount sufficient to treat a molten metal on an industrial scale. In addition, since the mixed gas is blown into the melt from the bottom of the furnace, the bubbling effect is very small in the region near the surface thereof in accordance with this process.

The primary object of the present invention is to provide a practical process for producing an ultra-low carbon stainless steel at low cost.

The secondary object of the present invention is to provide a process for producing an ultra-low carbon stainless steel, which is practicable on an industrial scale.

Thus, the present invention resides in a process for producing an ultra-low carbon stainless steel, which comprises preparing a molten metal of low carbon stainless steel by means of top-blowing of oxygen onto the surface of said molten metal contained in a vessel under reduced pressure, and, while maintaining said molten metal under reduced pressure, blowing a mixed gas of an oxidizing gas and an inert gas into the low carbon stainless steel molten metal through a lance immersed in the melt.

According to the present invention process, a mixed gas of an oxidizing gas and an inert gas is blown into the molten metal maintained under reduced pressure. Therefore, not only the pressure of atmosphere ($P_o$), but also the ratio of $V_{co}/(V_{co}=V)$ in the equation (1), are able to be made simultaneously so small that the established $P_{co}$ is sufficiently low to produce an ultra-low carbon stainless steel. Namely, the reduction in pressure $P_o$ is due to the employment of a reduced pressure atmosphere and the reduction in said ratio is due to the employment of the mixed gas which is blown into the melt. A typical oxidization gas is oxygen gas and a typical inert gas is argon gas. The mixed gas should be blown into the melt, not onto the surface thereof. Top-blowing is not sufficient to obtain the reduction of carbon content to an ultra-low range, e.g. less than 0.010% C, particularly less than 0.005% C, substantially without oxidation loss of chromium. For this purpose, the mixed gas is blown through a lance immersed to a depth of 10–50 cm in the melt under usual conditions.

It is preferable to control the mixing ratio of the oxidizing gas to the inert gas so that it may result in a ratio of $V_{co}/(V_{co}=V)$ of less than 0.7, more preferably less than 0.5. In general, it is desired that the ratio of the inert gas to the oxidizing gas be from 3 to 4. Since the introduction of the inert gas diluent may serve not only to cool the lance, but also to effect the bubbling of the melt in the region near the surface thereof, the inert gas is preferably introduced through the lance at a rate of 30–200 $m^3$/Hr for 40 tons of molten metal.

It is to be noted that in order to achieve a remarkable reduction in carbon content to below 0.01%, particularly below 0.005% without oxidation loss of chromium, it is necessary to provide bubbling of the melt particularly in the region near the surface thereof. According to the present invention process, as is apparent from the above, the blowing of the mixed gas through a lance immersed in the melt may also serve for this purpose. As in the conventional process, additional argon gas may also be introduced into the melt from the bottom of the furnace to further improve the bubbling action of the melt. It has been found that the amount of the additional argon gas required for this purpose is relatively low compared to the amount employed in the conventional processes, even in case of achiving decarburization to 0.003% or below.

Thus, in one embodiment of the present invention, a process for producing an ultra-low carbon stainless steel is provided, which comprises preparing a molten metal of low carbon stainless steel by means of top-blowing of oxygen onto the surface of said molten metal contained in a vessel under reduced pressure, and, while maintaining said molten metal under reduced pressure, blowing argon gas into the melt through a porous plug provided in the bottom of the vessel to effect bubbling of the melt and blowing a mixed gas of an oxidizing gas and an inert gas into the low carbon stainless steel through a lance immersed in the melt.

In practicing the process of the present invention the carbon content of a stainless steel molten metal is reduced in two stages. In the first stage, it is reduced to about 0.01%–0.1%, particularly to about 0.01–0.02%, and in the second stage it is reduced to below about 0.01%, particularly to about 0.005% or below.

A starting molten metal may be obtained from an electric furnace or an oxygen-blowing converter, the carbon content of which is, for example, in the range of from 0.2% to 0.3%.

Thus, the preparation of a low carbon stainless steel molten metal is carried out by blowing an oxygen gas onto the surface of the melt under reduced pressure to reduce the carbon content to about 0.1% or below, more particularly to about 0.01%–0.02%. The molten metal may be contained in a vessel placed in a vacuum chamber. However, from a practical viewpoint, it is preferable to use a vacuum refining furnace for the lid of which an oxygen-blowing lance is provided. The lance may be immersed in the melt. There is no essential difference between the top-blowing and the blowing through the immersed lance from a viewpoint of the effects on decarburization in the first stage. However, there is no need to immerse the lance in the first stage of carbon reduction. Rather, it is preferable to employ top-blowing to avoid unnecessary corrosion of the lining of the lance. Though another lance may be used for the top-blowing, it is convenient to use the same lance as that to be used under the melt in the next stage.

The thus obtained low carbon stainless steel molten metal is further subjected to a finishing decarburization to reduce the carbon content to about 0.01% or below, particularly to about 0.005% or below. The finishing decarburization is carried out by blowing a mixed gas of an oxidizing gas, such as oxygen, and an inert gas, such as argon, into the molten metal through a lance immersed into the melt at a depth in the melt. The finishing decarburization may follow the vacuum refining of the first stage while maintaining reduced pressure.

The fact that the same vacuum refining furnace may be used is advantageous from a practical viewpoint.

The process for producing an ultra-low carbon stainless steel of the present invention will be further described in conjunction with the drawings, in which:

FIGS. 1*a* to 1*d* diagrammatically show a sequence of operations for practicing the process of the present invention.

FIGS. 2*a* to 2*d* diagrammatically show another sequence of practicing the present invention process.

Now referring to the drawings, prior to the application of the present invention process, a chromium-containing molten pig iron 1 (e.g. C: 2–3%, Cr: 20%) is prepared in an electric furnace 2 provided with electrodes 3 (FIG. 1*a* and FIG. 2*a*). This molten metal 1 is subjected to primary decarburization in a converter 4 (FIG. 1*b*) or in an electric furnace 2 (FIG. 2*b*) by blowing oxygen onto the melt through a lance 5 until decarburization to about 0.3% C is established, while the oxidation loss of chromium may be suppressed effectively due to a high carbon content. In the case of the electric furnace, the oxygen blowing lance 5 may be inserted into the furnace through tap hole, as shown in FIG. 2*b*.

After the primary decarburization in converter 4 or electric furnace 2 is completed, the resuting molten metal (e.g. C: about 0.3%, Cr: 18%) is fed to a vessel for conducting the process of the present invention.

As shown in FIG. 1*c* and FIG. 2*c*, a ladle 6 into which the molten metal 7 has been tapped is placed within a vacuum ladle refining furnace 8, preferably a refining furnace having a bubbling inert gas inlet means in the bottom. Then the furnace 8 is evacuated, and, preferably while introducing an inert gas into the molten metal 7 from the bottom, pure oxygen is blown onto the surface of the molten metal 7 in the ladle 6 through a lance 9 having a lining 10 with a refractory material.

The decarburization with oxygen is continued until the carbon content reaches about 0.1%-0.01% resulting in a low carbon stainless steel molten metal. Next, preferably, while continuing bubbling of the molten metal by means of introduction of the inert gas from the bottom of the ladle, the lance 9 is immersed in the melt 7 (FIG. 1*d* and FIG. 2*d*). Through the immersed lance 9 a mixture of an oxidizing gas, such as oxygen, and an inert gas, such as argon, is supplied to the melt 11. During the operation the furnace 8 is kept under reduced pressure. Thus, decarburization takes place to an ultra-low carbon range, i.e., approximately below about 0.01% C, and particularly 0.005% or less.

Instead of evacuating the vacuum chamber 8, the ladle 6 may be evacuated without using the vacuum chamber.

According to the process of present invention it is preferable to control the blowing of the $Ar=O_2$ mixture gas into the melt in the vacuum chamber 8 so that the ratio of $V_{co}/(V_{co}=V)$ is kept at less than 0.7, and preferably less than 0.5. In this case, the volume ratio of $Ar/O_2$ may be within the range of from 3 to 4. The ratio of $V_{co}/(V_{co}+V)$ may be determined by the analysis of gas composition within the vacuum chamber 8.

The addition of the inert gas to the oxygen gas is effective not only for the dilution of the blowing gas, which results in the reduction of the $P_{co}$, but also for the production of fine bubbles dispersed throughout the melt, resulting in the bubbling action of the melt in the region near the surface thereof. The bubbling action of the melt, therefore, may serve to increase the area of the reaction-interface between the melt and the chromium oxide. Thus, the introduction of the inert gas together with the oxidizing gas into the melt maintained under reduced pressure is markedly effective for decarburization of the melt to an ultra-low carbon range. Furthermore, this can be established only by blowing the mixed gas into the melt through the immersed lance.

Of course, an additional inert gas may also be introduced into the melt from the bottom of the furnace.

In addition, when the same lance is used in the first and second decarburization stages, the decarburization of the melt from a low carbon range to an ultra-low carbon range is carried out continuously without any significant oxidation loss of chromium. No additional equipment except for the lance with a lining of a refractory material is required for working the process of the present invention. This is very important from a practical viewpoint.

Therefore, the present invention process can bring about a practical process for continuously producing an ultra-low carbon stainless steel.

The present invention will be described in more detail with reference to the several working examples of the process of the present invention.

EXAMPLE 1

After primary decarburization, a molten metal containing 0.31% C, 18.0% Cr and 2.0% Mo was treated by blowing oxygen through a lance onto the surface of the melt in a ladle placed within a vacuum chamber. Thirty-nine tons of low carbon stainless steel melt having the composition: C: 0.012%, Cr: 17.8%, Mo: 1.9% was obtained.

Then, the lance was immersed in the melt at a temperature of 1702° C. to a depth of 30 cm. Through this immersed lance a mixed gas of Ar and $O_2$ (Ar=165 $m^3$/Hr and $O_2$−55 $m^3$/Hr) was blown into the molten steel while maintaining a pressure of 7 Torrs for 15 minutes to effect decarburization.

After blowing for 15 minutes, an ultra-low carbon stainless steel having the composition of C: 0.0031%, Cr: 17.6%, Mo: 1.8% was obtained. The temperature of the molten steel after refining was 1675° C.

EXAMPLE 2

After primary decarburization, a molten metal containing 0.35% C and 30.9% Cr was treated by blowing oxygen through a lance onto the surface of the melt in a ladle placed within a vacuum chamber. Forty tons of low carbon stainless steel melt having the composition: C: 0.011%, Cr: 30.2%, was obtained.

Then, the lance was immersed in the melt at a temperature of 1695° C. to a depth of 40 cm. Through this immersed lance a mixed gas of Ar and $O_2$ (Ar=165 $m^{3/Hr\ and}$ $O_2$=41 $m^3$/Hr) was blown into the molten steel while maintaining a pressure of 6 Torrs for 15 minutes to effect decarburization.

After blowing for 15 minutes, an ultra-low carbon stainless steel having the composition of C: 0.0039%, Cr: 29.7% was obtained. The temperature of the molten steel after refining was 1680° C.

EXAMPLE 3

After primary decarburization, a molten metal having 0.25% C, 17.9% Cr and 2.0% Mo was treated by blowing oxygen through a lance onto the surface of the melt in a ladle placed within a vacuum chamber. Forty tons of low carbon stainless steel melt having the composition: C: 0.011%, Cr: 17.6%, Mo: 2.0% was obtained.

Then, the lance was immersed in the melt at a temperature of 1705° C. to a depth of 40 cm. Through this immersed lance a mixed gas of Ar and $O_2$ (Ar=150 $m^3$/Hr and $O_2$=50 $m^3$/Hr) was blown into molten steel while maintaining a pressure of 6 Torrs for 16 minutes to effect decarburization. The oxygen-argon gas was blown into the melt while blowing additional argon gas from the bottom of the ladle at a rate of 70 l/min.

After blowing for 16 minutes, an ultra-low carbon stainless steel having composition of C: 0.0021%, Cr: 17.4%, Mo: 1.9% was obtained. The temperature of the molten steel after refining was 1672° C.

EXAMPLE 4

After primary decarburization, a molten metal having 0.32% C, and 30.7% Cr was treated by blowing oxygen through a lance onto the surface of the melt in a ladle placed within a vacuum chamber. Forty-one tons of low carbon stainless steel melt having the composition: C: 0.010%, Cr: 30.1% was obtained.

Then, the lance was immersed in the melt at a temperature of 1698° C. to a depth of 40 cm. Through this immersed lance a mixed gas of Ar and $O_2$ (Ar=160 $m^3$/Hr and $O_2$=40 $m^3$Hr) was blown into the molten steel while maintaining a pressure of 6 Torrs for 14 minutes to effect decarburization. The oxygen-argon gas was blown into the melt while blowing additional argon gas from the bottom of the ladle at a rate of 70 l/min.

After blowing for 14 minutes, an ultra-low carbon stainless steel having the composition of C: 0.0035%, Cr: 29.6% was obtained. The temperature of the molten steel after refining was 1682° C.

What is claimed is:

1. A process for producing an ultra-low carbon stainless steel which comprises preparing a molten metal melt of low carbon stainless steel by top-blowing an oxidizing gas onto the surface of said molten metal contained in a vessel under reduced pressure, and while maintaining said molten metal under reduced pressure, blowing a mixed gas of an oxidizing gas and an inert gas into the low carbon stainless steel molten metal through a lance immersed in the melt.

2. A process according to claim 1, in which the mixing ratio of the oxidizing gas and the inert gas is controlled so that the ratio of $V_{co}/(V_{co}+V)$ is less than 0.7.

3. A process according to claim 1, in which the carbon content of said low carbon stainless steel is in the range of from 0.01 to 0.02%, and the carbon content of said ultra-low carbon stainless steel is below 0.01%.

4. A process according to claim 1, in which the said low carbon stainless steel is prepared by blowing said oxidizing gas onto the surface of the molten metal through a lance, then immersing the lance in the melt and blowing said mixed gas into the melt through the immersed lance.

5. A process according to claim 1, in which said oxidizing gas is oxygen gas and said inert gas is argon gas.

6. A process for producing an ultra-low carbon stainless steel, which comprises preparing a molten metal melt of low carbon stainless steel top-blowing an oxidizing gas onto the surface of said molten metal contained in a vessel under reduced pressure, bubbling said molten metal by introducing an inert gas into the melt from the bottom of said vessel, and while maintaining said molten metal under reduced pressure and bubbling said molten metal, blowing a mixed gas of an oxidizing gas and an inert gas into the low carbon stainless steel molten metal through a lance immersed in the melt.

7. A process according to claim 6, in which the mixing ratio of the oxidizing gas and the inert gas is controlled so that a ratio of $V_{co}/(V_{co}+V)$ is less than 0.7.

8. A process according to claim 6, in which the carbon content of said low carbon stainless steel is in the range of from 0.01 to 0.02%, and the carbon content of said ultra-low carbon stainless steel is below 0.01%.

9. A process according to claim 6, in which said low carbon stainless steel is prepared by blowing said oxidizing gas onto the surface of the molten metal through a lance, then immersing the lance in the melt and blowing said mixed gas into the melt through the immersed lance.

10. A process according to claim 6, in which said oxidizing gas is oxygen gas and said inert gas is argon gas.

* * * * *

UNITED STATES PATENT AND TRADEMARK OFFICE

CERTIFICATE OF CORRECTION

PATENT NO. : 4,160,664

DATED July 10, 1979

INVENTOR(S) : Shigeaki MARUHASHI and Yoshio KOBAYASHI

It is certified that error appears in the above-identified patent and that said Letters Patent are hereby corrected as shown below:

Column 1, line 67:

"$P_{CO}=P_O=V_{CO}/(V_{CO}=V)$" should be

-- $P_{CO}=P_O \times V_{CO}/(V_{CO} + V)$ --.

Column 2, line 6; Column 2, line 11; Column 2, line 18; Column 3, line 10; Column 3, line 28 and Volumn 5, line 24:

"$V_{CO}/(V_{CO}=V)$" should be -- $V_{CO}/(V_{CO} + V)$ --.

Column 2, line 26:

"metal-slug" should be -- metal slag --.

Column 5, line 22:

"$Ar = O_2$" should be -- $Ar + O_2$ --.

Signed and Sealed this

Seventh Day of April 1981

[SEAL]

Attest:

RENE D. TEGTMEYER

Attesting Officer

Acting Commissioner of Patents and Trademarks